US010650953B2

(12) United States Patent
Yoshikawa et al.

(10) Patent No.: US 10,650,953 B2
(45) Date of Patent: May 12, 2020

(54) REACTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Kohei Yoshikawa, Mie (JP); Takashi Misaki, Mie (JP); Seiji Shitama, Mie (JP); Tatsuo Hirabayashi, Mie (JP); Shinichiro Yamamoto, Mie (JP)

(73) Assignees: AutoNetworks Technologies, Ltd., Yokkaichi, Mie (JP); Sumitomo Wiring Systems, Ltd., Yokkaichi, Mie (JP); Sumitomo Electric Industries, Ltd., Osaka-Shi, Osaka (JP)

( * ) Notice: Subject to any disclaimer, the term of this patent is extended or adjusted under 35 U.S.C. 154(b) by 70 days.

(21) Appl. No.: 15/991,492

(22) Filed: May 29, 2018

(65) Prior Publication Data

US 2019/0027294 A1 Jan. 24, 2019

(30) Foreign Application Priority Data

Jul. 18, 2017 (JP) ..... 2017-139336

(51) Int. Cl.
*H01F 27/30* (2006.01)
*H01F 27/24* (2006.01)
(Continued)

(52) U.S. Cl.
CPC ..... *H01F 27/24* (2013.01); *H01F 3/14* (2013.01); *H01F 27/255* (2013.01);
(Continued)

(58) Field of Classification Search
CPC ..... H01F 3/14; H01F 27/24; H01F 27/306; H01F 27/255; H01F 27/266; H01F 27/26; H01F 27/263; H01F 27/324; H01F 37/00
(Continued)

(56) References Cited

U.S. PATENT DOCUMENTS

2009/0108971 A1* 4/2009 Okamoto ..... H01F 27/266 336/65
2013/0106556 A1* 5/2013 Suzuki ..... B29C 70/68 336/212
(Continued)

FOREIGN PATENT DOCUMENTS

JP 2017-028142 A 2/2017

*Primary Examiner* — Mang Tin Bik Lian
(74) *Attorney, Agent, or Firm* — Honigman LLP

(57) ABSTRACT

A reactor includes: a coil having winding portions; a magnetic core including inner core portions and a pair of outer core portions sandwiching the inner core portions; end surface interposed members including main body portions between end surfaces of the winding portions and outer core portions, and resin filling holes communicating with interiors of the winding portions; inner resin portions where spaces between inner circumferential surfaces of the winding portions and inner core portions are filled; and outer resin portions covering part of the outer core portions and are connected to the inner resin portions through the resin filling holes. At least one of the pair of outer core portions and an end surface interposed member are formed integrally. The end surface interposed member includes a core holding portion extending to the outer core portion side and interposed between the core holding member and the main body portion.

5 Claims, 5 Drawing Sheets

(51) Int. Cl.

| | |
|---|---|
| ***H01F 3/14*** | (2006.01) |
| ***H01F 27/255*** | (2006.01) |
| ***H01F 37/00*** | (2006.01) |
| ***H01F 27/26*** | (2006.01) |

(52) U.S. Cl.
CPC ..... *H01F 27/266* (2013.01); *H01F 27/306* (2013.01); *H01F 37/00* (2013.01)

(58) Field of Classification Search
USPC ..... 336/188, 198, 208, 212, 205, 178, 210
See application file for complete search history.

(56) References Cited

U.S. PATENT DOCUMENTS

| | | | | |
|---|---|---|---|---|
| 2013/0249666 | A1* | 9/2013 | Suzuki | H01F 27/263 336/210 |
| 2014/0218152 | A1* | 8/2014 | Ueno | H01F 37/00 336/165 |
| 2015/0043262 | A1* | 2/2015 | Ito | H01F 37/00 363/131 |
| 2015/0130576 | A1* | 5/2015 | Suzuki | H01F 27/00 336/92 |
| 2016/0322150 | A1* | 11/2016 | Inaba | H01F 27/08 |

* cited by examiner

REACTOR

CROSS-REFERENCE TO RELATED APPLICATIONS

This application claims priority of Japanese Patent Application No. JP 2017-139336 filed Jul. 18, 2017.

FIELD OF THE INVENTION

The present invention relates to a reactor.

BACKGROUND OF THE INVENTION

A reactor is a component of a circuit that performs a voltage step-up operation and a voltage step-down operation. For example, JP 2017-28142A discloses a reactor including: a coil having winding portions that are formed by winding a winding wire; a magnetic core that is arranged inside and outside of the winding portions and forms a closed magnetic circuit; and an insulating interposed member that is interposed between the winding portions and the magnetic core. The above-described magnetic core includes inner core portions that are arranged inside of the winding portions and outer core portions that are arranged outside of the winding portions. The insulating interposed member includes inner interposed members that are interposed between the inner circumferential surfaces of the winding portions and the inner core portions, and end surface interposed members that are interposed between the end surfaces of the winding portions and the outer core portions. Also, the reactor disclosed in JP 2017-28142A includes inner resin portions that fill the spaces between the inner circumferential surfaces of the winding portions and the inner core portions, and outer resin portions that cover part of the outer core portions.

In the reactor disclosed in JP 2017-28142A, intervals (resin flow paths) are formed between the inner circumferential surfaces of the winding portions and the inner core portions by the inner interposed members. Also, the outer circumferences of the outer core portions are covered with resin, the resin is introduced through resin filling holes formed in the end surface interposed members, and the resin fills the resin flow paths formed between the winding portions and the inner core portions from the end surface sides of the winding portions, whereby the outer resin portions and the inner resin portions are formed integrally.

SUMMARY OF THE INVENTION

A method of performing resin molding by arranging a combined body obtained by combining a coil, a magnetic core, and an insulating interposed member in a mold and injecting resin into the mold is an example of a method for manufacturing the above-described reactor. The resin injected into the mold covers the outer circumference of the outer core portions to form the outer resin portions and flows between the winding portions and the inner core portions via resin filling holes to form the inner resin portions. In general, the injection of the resin into the mold is performed by applying pressure to the resin through injection molding, but it is necessary to apply a high pressure in order to cause the resin to sufficiently spread to the narrow intervals between the inner circumferential surfaces of the winding portions and the inner core portions. If the pressure of the resin is increased, there is a risk that the outer core portions will move due to the pressure and position misalignment will occur.

In view of this, for example, it is conceivable to provide protrusions (pins) that fix the outer core portions in the mold and bring the outer core portions into contact with the protrusions, so that the outer core portions do not move in the mold. However, in this case, the surfaces of the outer core portions that come into contact with the protrusions are not covered with the resin and are exposed from the outer resin portions, and therefore there is concern that rusting will occur at the parts of the outer core portions that are exposed from the outer resin portions.

In view of this, the present disclosure aims to provide a reactor that can suppress position misalignment of an outer core portion when the inner resin portions are formed by resin filling the spaces between the inner circumferential surfaces of the winding portions of the coil and the inner core portions of the magnetic cores.

A reactor according to the present disclosure is a reactor including: a coil having winding portions; a magnetic core including inner core portions arranged inside of the winding portions and a pair of outer core portions arranged outside of the winding portion so as to sandwich the inner core portions; end surface interposed members including main body portions that are interposed between end surfaces of the winding portions and the outer core portions, and resin filling holes that communicate with the interiors of the winding portions; inner resin portions that fill spaces between inner circumferential surfaces of the winding portions and the inner core portions; and outer resin portions that cover at least part of the outer core portions and are connected to the inner resin portions through the resin filling holes, wherein at least one of a pair of the outer core portions and an end surface interposed member are constituted by a core component that is formed integrally, and the end surface interposed member of the core component includes a core holding portion that is extended from the main body portion to the outer core portion side, the outer core portion being interposed between the core holding portion and the main body portion.

The above-described reactor can suppress position misalignment of an outer core portion when the inner resin portions are formed by filling the spaces between the inner circumferential surfaces of the winding portions of the coil and the inner core portions of the magnetic core with resin.

DETAILED DESCRIPTION OF THE PREFERRED EMBODIMENTS

Figure 1:
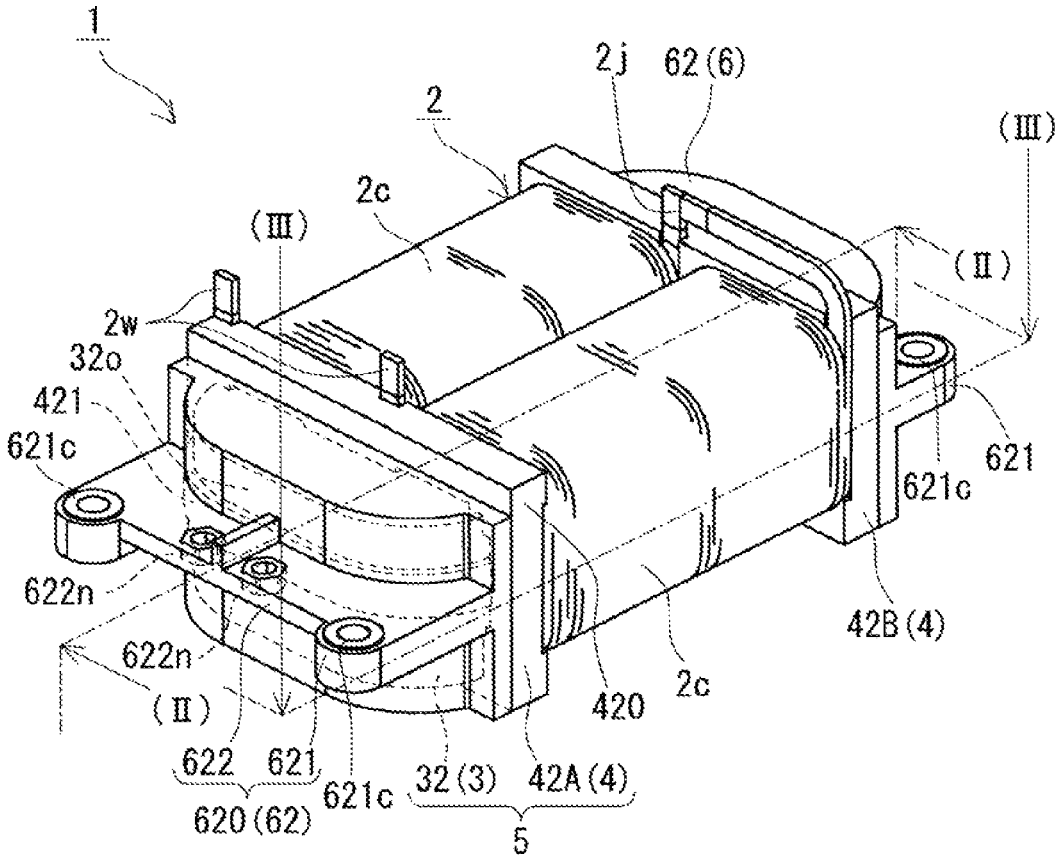
FIG. 1 is a schematic perspective view of a reactor according to Embodiment 1.

First, embodiments of the present invention will be listed and described.

(1) The reactor according to an aspect of the present invention is a reactor including: a coil having winding portions; a magnetic core including inner core portions arranged inside of the winding portions and a pair of outer core portions arranged outside of the winding portion so as to sandwich the inner core portions; end surface interposed members including main body portions that are interposed between end surfaces of the winding portions and the outer core portions, and resin filling holes that communicate with the interiors of the winding portions; inner resin portions that fill spaces between inner circumferential surfaces of the winding portions and the inner core portions; and outer resin portions that cover at least part of the outer core portions and are connected to the inner resin portions through the resin filling holes, wherein at least one of a pair of the outer core portions and an end surface interposed member are constituted by a core component that is formed integrally, and the end surface interposed member of the core component includes a core holding portion that is extended from the main body portion to the outer core portion side, the outer core portion being interposed between the core holding portion and the main body portion.

The above-described reactor includes a core component in which an outer core portion and an end surface interposed member are provided integrally, and thus the outer core portion and the end surface interposed member can be treated as an integral object in a positioned state. Also, due to the outer core portion in the core component being interposed between the main body portion of the end surface interposed member and the core holding portion, it is possible to suppress a case in which a malfunction occurs, such as a case in which the outer core portion comes off from the end surface interposed member or the end surface interposed member deforms due to the injection pressure of the resin in the process of forming the inner resin portions and the outer resin portions.

The above-described reactor includes: a one-side core holding mode in which one of the pair of outer core portions is constituted by a core component provided integrally with an end surface interposed member, and the other of the pair of outer core portions is constituted by another component provided separately from an end surface interposed member; and a two-side core holding mode in which both of the pair of outer core portions are constituted by core components that are provided integrally with the end surface interposed members. The inner resin portions and the outer resin portions can be formed by arranging the combined body obtained by combining the coil, the magnetic core, and the end surface interposed members in a mold, injecting resin into the mold, and performing resin molding. Examples of injecting the resin into the mold include a one-direction injection mode in which the resin is injected from the outer end surface side of the one outer core portion of the pair of outer core portions, and a two-direction injection mode in which the resin is injected from the outer end surface sides of both of the outer core portions of the pair of outer core portions.

In the one-direction injection mode, the outer circumferential surface of the one outer core portion on the side from which the resin is injected is pressed toward the end surface interposed member by the injection pressure of the resin, and thus the outer core portion substantially never falls toward the opposite side. However, if the other outer core portion located on the side opposite to the side from which the resin is injected is separate from the end surface interposed member, there is a risk that it will come off from the end surface interposed member by falling toward the side opposite to the end surface interposed member due to the injection pressure of the resin that flows between the winding portions and the inner core portions from the one outer core portion side. Since the outer core portion of the above-described reactor is held by being interposed between the main body portion and the core holding portion of the end surface interposed member, it is possible to suppress a case in which the outer core portion comes off by falling toward the side opposite to the end surface interposed member due to the injection pressure of the resin, even if the one-direction injection mode is used. In the case of one-direction injection, it is sufficient that at least the other outer core portion located on the side opposite to the side from which the resin is injected is constituted by the core component (one-side core holding mode), and both outer core portions may be constituted by the core components (two-side core holding mode).

In the two-direction injection mode, a difference between injection states can occur in which the filling state of the resin injected from the one outer core portion side and the filling state of the resin injected from the other outer core portion side are not uniform. For example, if the amount of resin in the outer resin portion that covers the other outer core portion is greater than the amount of resin in the outer resin portion that covers the one outer core portion, the above-described difference between the injection states can occur. In this case, if the other outer core portion is separate from the end surface interposed member, there is a risk that it will fall toward the side opposite to the end surface interposed member and come off from the end surface interposed member due to the injection pressure of the resin that flows between the winding portions and the inner core portions from the one outer core portion side. Since the outer core portion of the above-described reactor is held by being interposed between the main body portion and the core holding portion of the end surface interposed member, it is possible to suppress a case in which the outer core portion comes off by falling toward the side opposite to the end surface interposed member due to the injection pressure of the resin, even if a difference occurs between the injection states of the resin in the two-direction injection mode. In the case of two-direction injection, it is sufficient that the outer core portion on the side on which time is taken before the injected resin flows between the winding portions and the inner core portion, or for example, an outer core portion in which the covering outer resin portion has a large resin amount, is constituted by a core component (one-side core holding mode), and both outer core portions may be constituted by core components (two-side core holding mode).

(2) In one aspect of the above-described reactor, the core holding portion is provided continuously spanning from one side surface to another side surface of the outer core portion.

According to the above-described aspect, the outer circumferential surface of the outer core portion is held by being interposed between the main body portion and the core holding portion of the end surface interposed member so as to be retained, and therefore in the process of forming the inner resin portion and the outer resin portion, it is possible to further suppress a case in which the outer core portion comes off from the end surface interposed member and position misalignment occurs due to the injection pressure of the resin.

(3) In one aspect of the above-described reactor, the outer resin portion includes a protruding portion that covers the core holding portion and protrudes from the outer core portion.

In some cases, a fixing portion for fixing the reactor to an installation target and a terminal platform for fixing a terminal fitting to be attached to the winding end portions of the coil are formed on the outer resin portion. The fixing portion and the terminal platform are provided as protruding portions that protrude from the outer circumferential surface of the outer core portion. If the outer resin portion that covers the outer core portion in the core component has a thickness that is substantially uniform, the portion that covers the outer circumference of the outer core portion via the core holding portion bulges from the outer circumferential surface of the outer core portion with respect to the portion that directly covers the outer circumference of the outer core portion. In view of this, if the protruding portion is provided on the outer resin portion, the bulging portion is covered by the protruding portion due to the protruding portion being provided so as to cover the core holding portion, and therefore the bulging portion can be used as part of the protruding portion. By using the bulging portion as part of the protruding portion, the region other than the region in which the protruding portion of the outer core portion is provided can be set to a substantially uniform thickness, and a size increase of the reactor can be suppressed.

(4) In one aspect of the above-described reactor, the end surface interposed member in the core component includes an interposed wall portion that is interposed between the inner core portions and the outer core portion.

Due to the end surface interposed member including an interposed wall portion, it is possible to suppress a case in which the resin flows between the inner core portion and the outer core portion, and it is possible to suppress a case in which the gap length between the inner core portion and the outer core portion deviates from a predetermined value due to the injection pressure of the resin.

(5) In one aspect of the above-described reactor, the end surface interposed members include turn storage portions that store at least a portion of turns on axial direction end portions of the winding portions.

Due to the end surface interposed members including the turn storage portions, the winding portions can be positioned with respect to the end surface interposed members, the end surface interposed members and the end surfaces of the winding portions can be brought into surface contact with each other, and thus in the process of forming the inner resin portions and the outer resin portions, it is possible to suppress a case in which the resin leaks from the contact portions between the end surface interposed members and the winding portions.

A specific example of a reactor according to an embodiment of the present invention will be described hereinafter with reference to the drawings. Items with the same name are denoted by the same reference numerals in the drawings. Note that the present invention is not limited to these examples and is indicated by the claims, and meanings equivalent to the claims and all changes within the scope are intended to be encompassed therein.

Embodiment 1

A reactor 1 of Embodiment 1 will be described with reference to FIGS. 1 to 5.

Reactor

Overall Configuration

Figure 2:
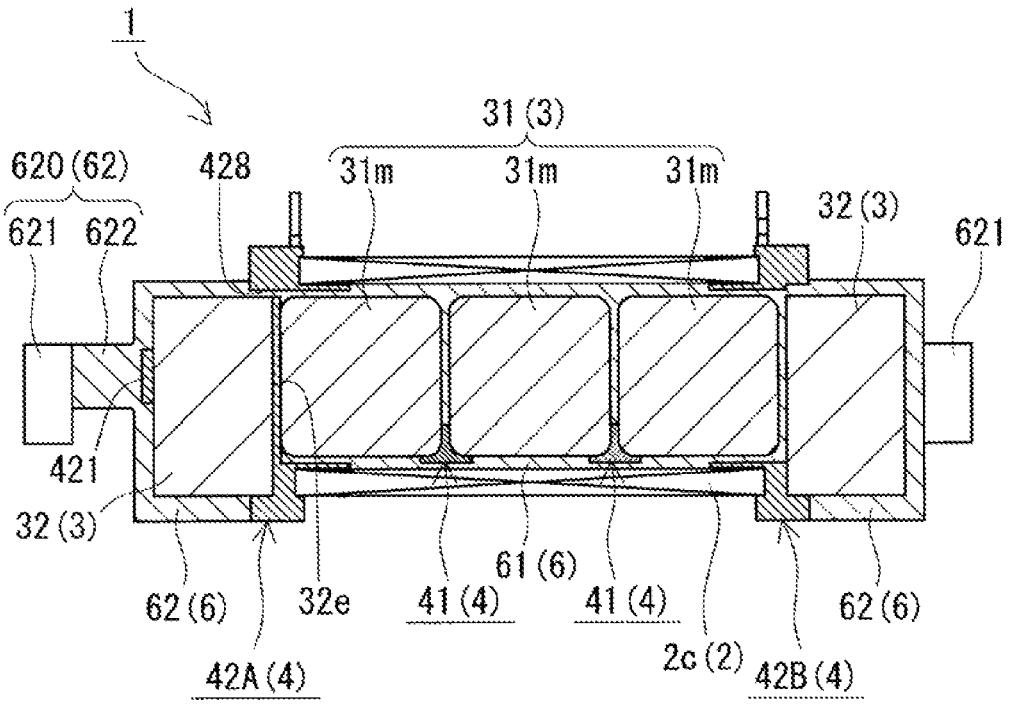
FIG. 2 is a schematic vertical cross-sectional view obtained by cutting along line (II)-(II) shown in FIG. 1.
Figure 3:
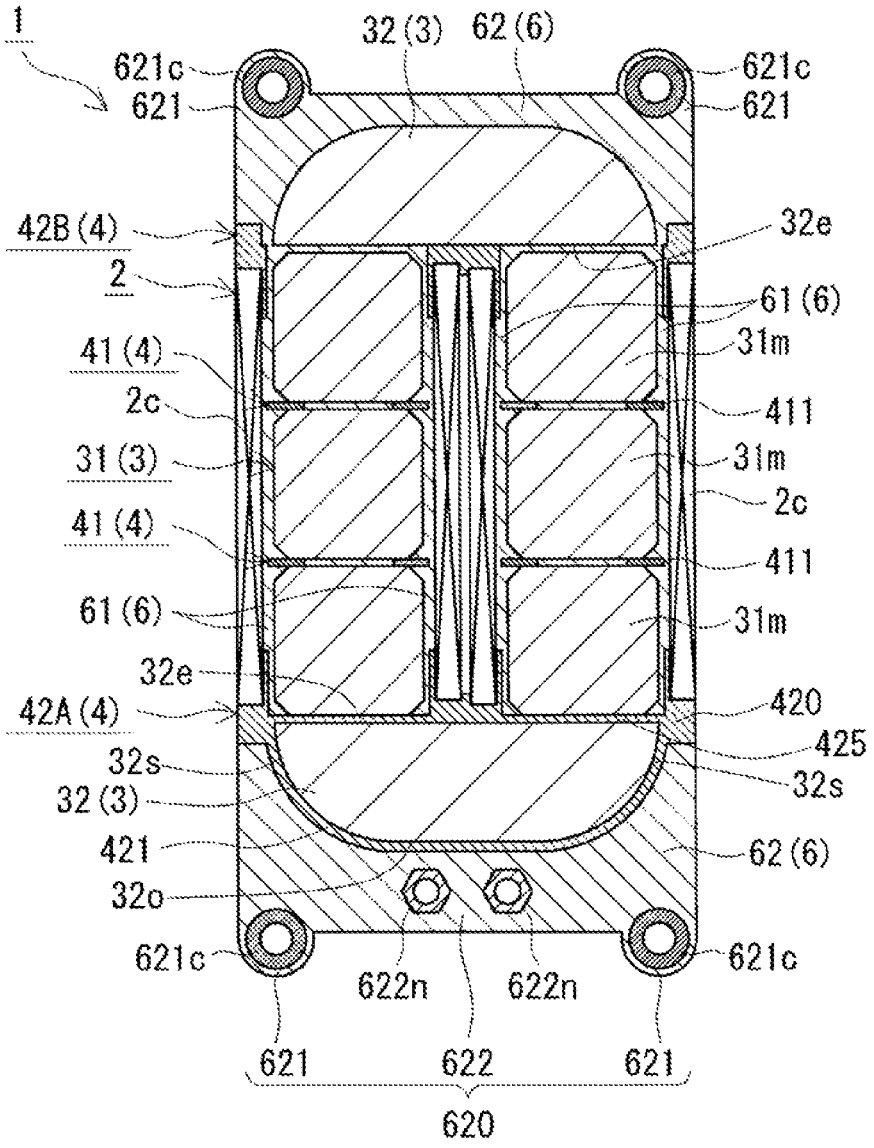
FIG. 3 is a schematic plane cross-sectional view obtained by cutting along line (III)-(III) shown in FIG. 1.
Figure 4:
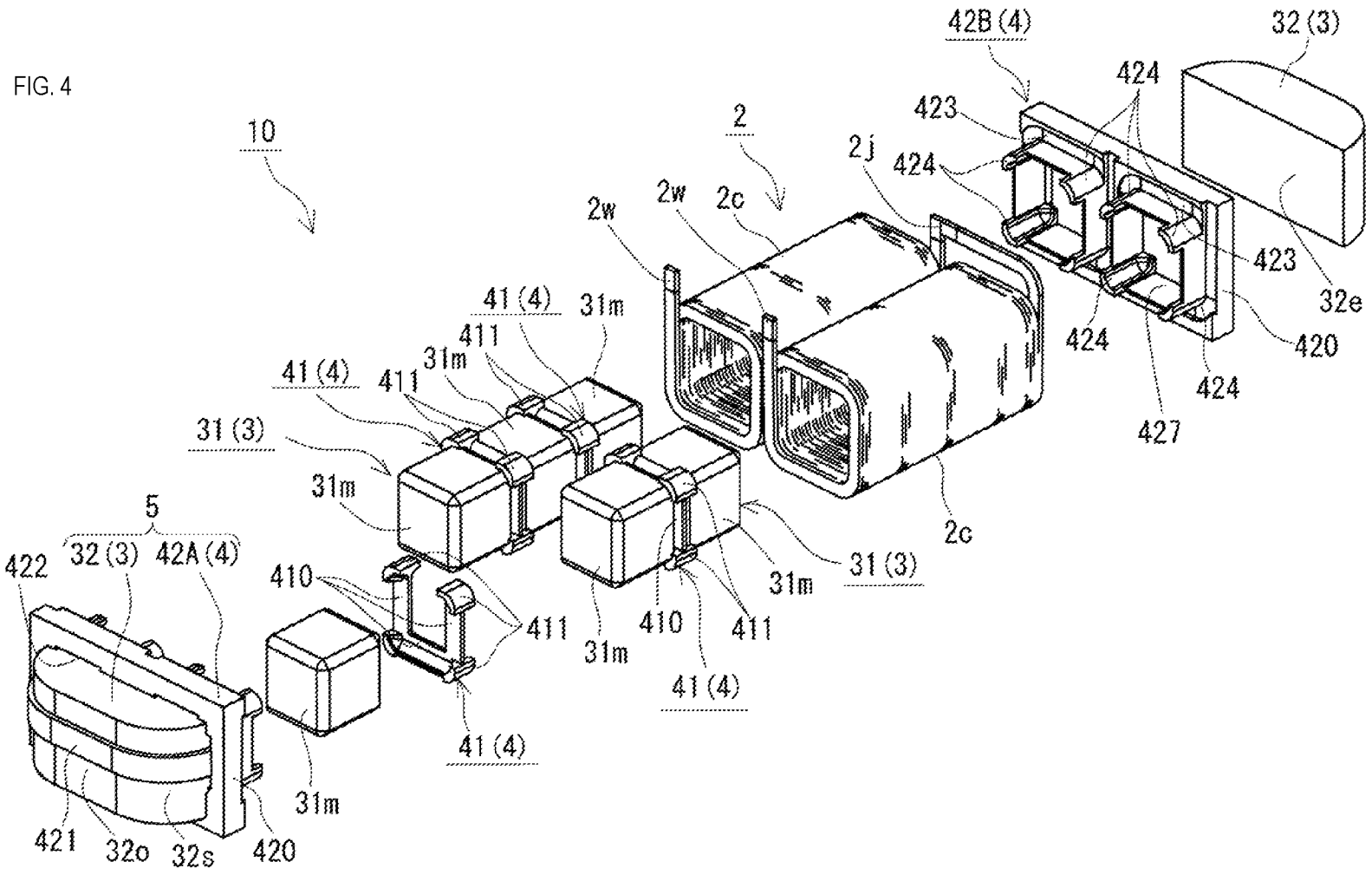
FIG. 4 is a schematic exploded perspective view of a combined body included in the reactor according to Embodiment 1.

As shown in FIGS. 1 to 4, the reactor 1 of Embodiment 1 includes a combined body 10 (see FIG. 4) obtained by combining a coil 2 having winding portions 2*c*, a magnetic core 3 that is arranged inside and outside of the winding portions 2*c* and forms a closed magnetic circuit, and insulating interposed members 4 interposed between the coil 2 and the magnetic core 3. The coil 2 includes two winding portions 2*c*, and the two winding portions 2*c* are arranged in horizontal alignment with each other. As shown in FIGS. 2 and 3, the magnetic core 3 includes two inner core portions 31 that are arranged inside of the winding portions 2*c* and two outer core portions 32 that are arranged outside of the winding portions 2*c* and connect the end portions of the two inner core portions 31. As shown in FIG. 4, the insulating interposed members 4 include inner interposed members 41 that are interposed between the inner circumferential surfaces of the winding portions 2*c* and the inner core portions 31, and end surface interposed members 42A and 42B having main body portions 420 that are interposed between the end surfaces of the winding portions 2*c* and the outer core portions 32. Also, as shown in FIGS. 2 and 3, the reactor 1 includes a molded resin portion 6 that integrally covers the magnetic core 3 (inner core portions 31 and outer core portions 32). The molded resin portion 6 includes inner resin portions 61 that fill the spaces between the inner circumferential surfaces of the winding portions 2*c* and the inner cores 31, and outer resin portions 62 that cover at least part of the outer core portions 32. The inner resin portions 61 and the outer resin portions 62 are formed integrally and are connected.

As shown in FIG. 4, one characteristic of the reactor 1 of Embodiment 1 is that it includes a core component 5 in which at least one of the two outer core portions 32 (in the present example, the one outer core portion 32) and the end surface interposed member 42A are provided integrally. Also, as shown in FIGS. 2 to 4, one characteristic of the reactor 1 of Embodiment 1 is that the end surface interposed member 42A of the core component 5 includes a core holding portion 421 that is extended from the main body portion 420 of the end surface interposed member 42A to the outer core portion 32 side, the outer core portion 32 being interposed between the core holding portion 421 and the main body portion 420.

Figure 5:
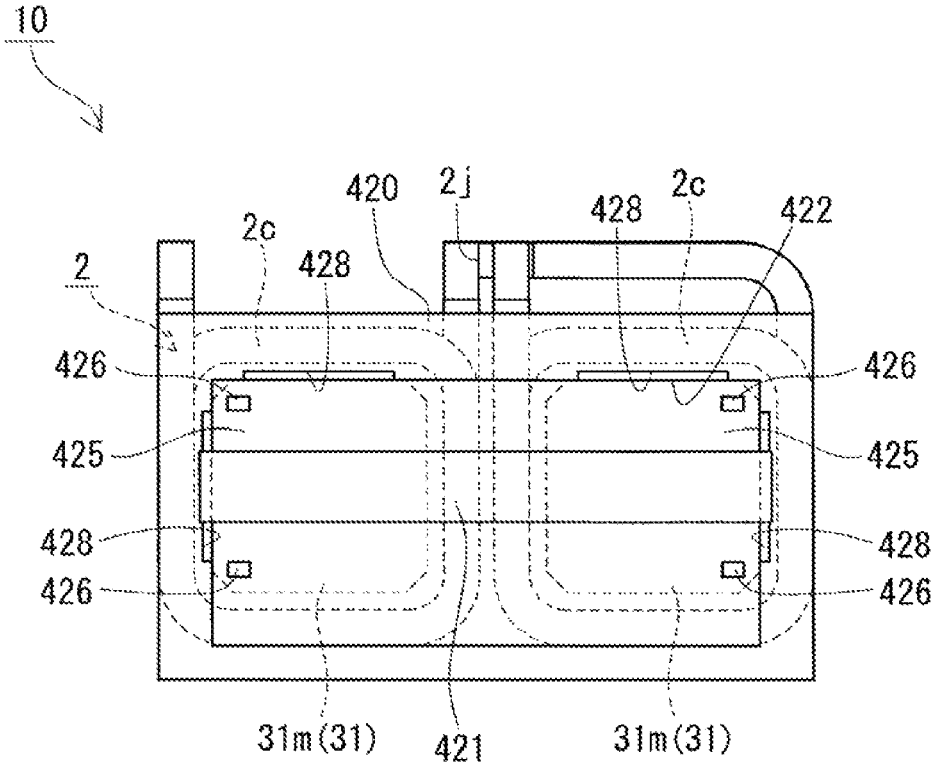
FIG. 5 is a schematic front view of a combined body included in the reactor according to Embodiment 1.

The reactor 1 is installed in an installation target (not shown) such as a converter case, for example. Here, in the reactor 1 (coil 2 and magnetic core 3), the lower portions of FIGS. 1 and 4 indicate the installation side that faces the installation target, the installation side is set as "down", the side opposite thereto is set as "up", and the up-down direction is set as the vertical direction (height direction). Also, the alignment direction (the left-right direction of FIG. 3) of the winding portions 2*c* of the coil 2 is set as the horizontal direction (width direction), and the direction along the axial direction (left-right direction in FIG. 2 and up-down direction in FIG. 3) of the coil 2 (winding portions 2*c*) is set as the length direction. FIG. 2 is a vertical cross-sectional view obtained by cutting in the vertical direction along the axial direction of the winding portions 2*c*, and FIG. 3 is a plane cross-sectional view obtained by cutting with a plane that divides the winding portions 2*c* into top and bottom. FIG. 5 is a front view of the combined body 10 taken from the core component 5 side, and for the sake of convenience in the description, the outer core portion 32 of the core component 5 is omitted. Hereinafter, configurations of the reactor 1 will be described in detail.

Coil

As shown in FIGS. 1 and 4, the coil 2 includes two winding portions 2*c* that are formed by respectively winding two winding wires 2*w* in the form of spirals, and end portions on one side of the winding wires 2*w* that form the two winding portions 2*c* are connected to each other via a bonding portion 2*j*. The two winding portions 2*c* are arranged in horizontal alignment (in parallel) such that the axial directions thereof are parallel. The bonding portion 2*j* is formed by bonding the end portions on the one side of the winding wires 2*w* pulled out from the winding portions 2*c*, using a bonding method such as welding, soldering, or brazing. The end portions on the other side of the winding wires 2*w* are pulled out in an appropriate direction (in the present example, upward) from the winding portions 2*c*. Terminal fittings (not shown) are attached as appropriate to the other end portions of the winding wires 2*w* and are electrically connected to an external apparatus (not shown) such as a power source. A known coil can be used as the coil 2, and for example, the two winding portions 2*c* may be formed with one continuous winding wire.

The two winding portions 2*c* are composed of winding wires 2*w* with the same specification and have the same shape, size, winding direction, and turn count, and the adjacent turns that form the winding portions 2*c* are adhered to each other. For example, the winding wires 2*w* are coated wires (so-called enamel wires) that have conductors (copper, etc.) and insulating coverings (polyamide-imide, etc.) on the outer circumferences of the conductors. In the present example, the winding portions 2*c* are quadrangular cylinder-shaped (specifically, rectangular cylinder-shaped) edgewise coils obtained by winding the winding wires 2*w*, which are coated flat wires, in an edgewise manner, and the end surface shapes of the winding portions 2*c* viewed from the axial direction are rectangular shapes with rounded corner portions. The shapes of the winding portions 2*c* are not particularly limited, and for example, may be cylinder-shaped, elliptical cylinder-shaped, ovoid cylinder-shaped (racetrack-shaped), or the like. The specifications of the winding wires 2*w* and the winding portions 2*c* can be changed as appropriate.

In the present example, as shown in FIG. 1, when the reactor 1 is formed without the coil 2 (winding portions 2*c*) being covered with the molded resin portion 6, the outer circumferential surface of the coil 2 is in an exposed state (see FIG. 2 as well). For this reason, it is easy to dissipate heat to the exterior from the coil 2, and the heat dissipation property of the coil 2 can be increased.

In addition, the coil 2 may be a molded coil molded using resin having an electrical insulating property. In this case, the coil 2 can be protected from the external environment (dust, corrosion, and the like) and the mechanical strength and electrical insulating property of the coil 2 can be increased. For example, due to the inner circumferential surfaces of the winding portions 2*c* being covered with resin, electrical insulation between the winding portions 2*c* and the inner core portions 31 can be increased. As the resin for molding the coil 2, for example, it is possible to use a thermosetting resin such as epoxy resin, unsaturated polyester resin, urethane resin, or silicone resin, or a thermoplastic resin such as polyphenylene sulfide (PPS) resin, polytetrafluoroethylene (PTFE) resin, liquid crystal polymer (LCP), polyimide (PA) resin such as nylon 6 and nylon 66, polyimide (PI) resin, polybutylene terephthalate (PBT) resin, and acrylonitrile butadiene styrene (ABS) resin.

Alternatively, the coil 2 may be a heat seal coil that includes heat seal layers between adjacent turns that form the winding portions 2*c*, and that is formed by heat sealing adjacent turns together. In this case, the adjacent turns can be further adhered together.

Magnetic Core

As shown in FIGS. 2 to 4, the magnetic core 3 includes two inner core portions 31 that are arranged inside of the winding portions 2*c* and two outer core portions 32 that are arranged outside of the winding portions 2*c*. The inner core portions 31 are portions that are located inside of the winding portions 2*c* arranged in horizontal alignment, and at which the coils 2 are arranged. In other words, the two inner core portions 31 are arranged in horizontal alignment (in parallel), similarly to the winding portions 2*c*. Parts of the end portions in the axial direction of the inner core portions 31 may protrude from the winding portions 2*c*. The outer core portions 32 are portions that are located outside of the winding portions 2*c*, and on which the coil 2 is substantially not arranged (i.e., portions that protrude (are exposed) from the winding portions 2*c*). The outer core portions 32 are arranged so as to sandwich the two inner core portions 31. In the present example, a ring-shaped magnetic core 3 is formed due to the end surfaces of the two inner core portions 31 opposing the inner end surfaces 32*e* of the outer core portions 32 and being connected thereto. When induction occurs due to a current being applied to the coil 2, a magnetic flux flows in the magnetic core 3, whereby a closed magnetic circuit is formed.

Inner Core Portions

The shapes of the inner core portions 31 correspond to the inner circumferential surfaces of the winding portions 2*c*. In the present example, the inner core portions 31 are formed in quadrangular prism shapes (rectangular prism shapes), and the end surface shapes of the inner core portions 31 viewed from the axial direction are rectangular shapes with chamfered corner portions. As shown in FIG. 4, the outer circumferential surfaces of the inner core portions 31 each have four flat surfaces (an upper surface, a lower surface, and two side surfaces) and four corner portions. Here, the sides of the two winding portions 2*c* that face each other are denoted as inner sides, and the opposite sides are denoted as outer sides, and among the two side surfaces, the side surfaces on the inner sides of the two winding portions 2*c* that oppose each other are denoted as inner side surfaces, and the side surfaces on the outer sides, which are located on the sides opposite to the inner sides, are denoted as outer side surfaces. Also, in the present example, as shown in FIGS. 2 to 4, the inner core portions 31 each include multiple inner core pieces 31*m* and the inner core pieces 31*m* are configured to be coupled in the length direction.

The inner core portions 31 (inner core pieces 31*m*) are formed with a material that contains a soft magnetic material. For example, the inner core pieces 31*m* are formed with pressed powder molded bodies obtained by press-molding a soft magnetic powder such as iron or an iron alloy (Fe—Si alloy, Fe—Si—Al alloy, Fe—Ni alloy, or the like), a coating soft magnetic powder further including an insulating coating, and the like, molded bodies made of a composite material containing a soft magnetic powder and a resin, or the like. As the resin for the composite material, it is possible to use a thermosetting resin, a thermoplastic resin, a normal-temperature curable resin, a low-temperature curable resin, or the like. Examples of thermosetting resins include unsaturated polyester resin, epoxy resin, urethane resin, and silicone resin. Examples of thermoplastic resins include PPS resin, PTFE resin, LCP, PA resin, PI resin, PBT resin, and ABS resin. In addition, it is also possible to use a BMC (bulk molding compound) obtained by mixing calcium carbonate and glass fiber into unsaturated polyester, millable silicone rubber, millable urethane rubber, or the like. In the present example, the inner core pieces 31*m* are formed with pressed powder molded bodies.

Outer Core Portions

The outer core portions 32 are each constituted by one core piece. Similarly to the inner core pieces 31*m*, the outer core portions 32 are formed with a material containing a soft magnetic material, and it is possible to use the above-described pressed powder molded bodies, composite materials, or the like thereas. In this example, the outer core portions 32 are formed with pressed powder molded bodies.

As shown in FIGS. 3 and 4, the outer core portions 32 each include an upper surface, a lower surface, and a circumferential surface. Here, the side of the circumferential surface that faces the end surfaces of the two inner core portion 31 is an inner end surface 32*e*, the side opposite thereto is an outer end surface 32*o*, and the sides that connect the inner end surface 32*e* and the outer side surface 32*o* are side surfaces 32*s*. The shape of the outer core portions 32 is not particularly limited, as long as a closed magnetic loop is formed due to the outer core portions 32 being combined with the inner core portions 31. In the present example, as shown in FIG. 2, when the magnetic core 3 is formed, the outer core portions 32 protrude downward with respect to the inner core portions 31 and the lower surfaces of the outer core portions 32 are level with the lower surface of the coil 2 (winding portions 2*c*). The upper surfaces of the outer core portions 32 are level with the upper surfaces of the inner core portions 31.

Insulating Interposed Members

The insulating interposed members 4 are members that are interposed between the coil 2 (winding portions 2*c*) and the magnetic core 3 (inner core portions 31 and outer core portions 32) and that ensure electrical insulation between the coil 2 and the magnetic core 3, and include the inner interposed members 41 and the end surface interposed members 42A and 42B. The insulating interposed members 4 are formed with resin having an electrical insulating property, such as epoxy resin, unsaturated polyester resin, urethane resin, silicone resin, PPS resin, PTFE resin, LCP, PA resin, PI resin, PBT resin, or ABS resin. In this example, the inner interposed members 41 and the end surface interposed members 42A and 42B are formed with PPS resin.

Inner Interposed Members

As shown in FIGS. 2 and 4, the inner interposed members 41 are interposed between the inner circumferential surfaces of the winding portions 2*c* and the outer circumferential surfaces of the inner core portions 31, and ensure electrical insulation between the winding portions 2*c* and the inner core portions 31. Also, between the inner circumferential surfaces of the winding portions 2*c* and the outer circumferential surfaces of the inner core portions 31, and between the adjacent inner core pieces 31*m*, the inner interposed members 41 form intervals that are to serve as flow paths for resin that is to form the inner resin portions 61 (see FIGS. 2 and 3). In the present example, as shown in FIG. 4, the inner interposed members 41 include plate-shaped partitioning portions 410 that are interposed between the inner core pieces 31*m*, and protruding pieces 411 that are formed on the corner portions of the partitioning portions 410 and extend in the length direction along the corner portions of the adjacent inner core pieces 31*m*. The partitioning portions 410 shown in the present example are formed into U shapes whose upper sides are open. The partitioning portions 410 hold the intervals between the adjacent inner core pieces 31*m* and form gaps between the inner core pieces 31*m*. The protruding pieces 411 hold the corner portions of the inner core pieces 31*m*, are interposed between the inner circumferential surfaces of the winding portions 2*c* and the outer circumferential surfaces of the inner core pieces 31*m*, and position the inner core pieces 31*m* (inner core portions 31) in the winding portions 2*c*. Intervals are formed between the inner circumferential surfaces of the winding portions 2*c* and the outer circumferential surfaces of the inner core portions 31 by the protruding pieces 411, and the intervals are ensured at the four surfaces (upper surface, lower surface, and both side surfaces) of each inner core portion 31. The inner resin portions 61 (see FIGS. 2 and 3) are formed by resin filling the intervals between the inner circumferential surfaces of the winding portions 2*c* and the outer circumferential surfaces of the inner core portions 31 and the spaces between the adjacent inner core pieces 31*m*.

End Surface Interposed Members

As shown in FIGS. 1 and 4, the end surface interposed members 42A and 42B include main body portions 420 that are interposed between the end surfaces of the winding portions 2*c* and the inner end surfaces 32*e* of the outer core portions 32, and ensure electrical insulation between the winding portions 2*c* and the outer core portions 32. The one end surface interposed member 42A located on the side (the left side in FIGS. 1, 2, and 4, and the lower side in FIG. 3) on which the end portions of the coil 2 (winding wire 2*w*) are pulled out is constituted by the core component 5 that is provided integrally with the outer core portion 32. In the present example, the other end surface interposed member 42B located on the side (right side in FIGS. 1, 2, and 4, and the upper side in FIG. 3) of a bonded portion 2*j* at which the end portions of the coil 2 (winding wire 2*w*) are bonded is provided separately from the outer core portion 32. For this reason, in the present example, the shape of the one end surface interposed member 42A and the shape of the other end surface interposed member 42B are different from each other.

One End Surface Interposed Member

The end surface interposed member 42A constituted by the core component 5 includes a main body portion 420 constituted by a frame-shaped member with an approximate B shape. In the present embodiment, as shown in FIG. 5, the interposed wall portion 425 is formed integrally on the inner side of the frame-shaped member and the end surface interposed member 42B closes the inner side of the frame portion of the main body portion 420. The end surface interposed member 42A is provided integrally with the outer core portion 32 through insert molding, for example. For this reason, the outer core portion 32 is held in a state of being in close contact with the end surface interposed member 42A. The method for manufacturing the core component 5 in which the outer core portion 32 and the end surface interposed member 42A are provided integrally will be stated in detail in the later-described method for manufacturing the reactor.

The end surface interposed member 42A includes: an interposed wall portion 425 (FIG. 5) that is interposed between the inner core portion 31 and the outer core portion 32; a core holding portion 421 and core storage portion 422 on the side on which the outer core portion 32 is arranged, relative to the interposed wall portion 425; and turn storage portions 423 and protruding pieces 424 on the side on which the inner core portions 31 are arranged, relative to the interposed wall portion 425. Note that although the turn storage portions 423 and the protruding pieces 424 will be described with reference to the other end surface interposed member 42B in FIG. 4, similar configurations are present in the one end surface interposed member 42A as well.

Interposed Wall Portion

The interposed wall portion 425 is a square plate-shaped portion that is formed in the central portion of the main body portion 420, and is interposed between the inner core portions 31 and the outer core portion 32. The interposed wall portion 425 functions as a gap portion between the inner core portions 31 and the outer core portion 32. The interposed wall portion 425 is thinner than the main body portion 420. Pin marks at which pins for holding the outer core portion 32 came into contact with predetermined positions of the mold when the outer core portion 32 and the end surface interposed member 42A were integrated are left as pin holes 426 (FIG. 5) in the interposed wall portion 425.

Core Holding Portion

The core holding portion 421 is extended from the main body portion 420 to the outer core portion 32 side, and the outer core portion 32 is interposed between the core holding portion 421 and the main body portion 420. The core holding portion 421 preferably covers at least part of the side surface 32*s* and the outer end surface 32*o* on the side of the outer core portion 32 opposite to the winding portion 2*c* and the inner core portion 31. In particular, it is preferable that at least part of the outer end surface 32*o* is covered. Also, the core holding portion 421 is preferably provided so as to be extended from the two sides of the main body portion 420 and surround the outer core portion 32 along the two side surfaces 32*s* and the outer end surface 32*o* of the outer core portion 32. The core holding portion 421 is provided so as to be in close contact with the side surfaces 32*s* and the outer end surface 32*o* of the outer core portion 32.

The core holding portion 421 has a function of suppressing a case in which the outer core portion 32 comes off and is misaligned due to the injection pressure of the resin in the process of forming the later-described molded resin portion 6. The function of the core holding portion 421 will be described in the later-described method for manufacturing the reactor. The total length of the core holding portion 421 in the circumferential direction of the outer core portion 32, or in other words, the total length in the extension direction from the holding portion 420 is preferably 10% or more, more preferably 50% or more, and particularly preferably 100% (full width), of the total length in the circumferential direction of the side surfaces 32*s* and the outer end surface 32*o* of the outer core portion 32. By doing so, it is easier to suppress a case in which the outer core portion 32 comes off and position misalignment occurs due to the injection pressure of the resin in the process of forming the molded resin portion 6. In the present example, the core holding portion 421 is provided so as to be continuous over the entire width from one side surface 32*s* to the other side surface 32*s* of the outer core portion 32 along the circumferential direction of the side surfaces 32*s* and the outer end surface 32*o* of the outer core portion 32. If the core holding portion 421 is not provided along the entire width of the outer core portion 32, or in other words, if the core holding portion 421 has a slit in the width direction of the outer core portion 32, the core holding portion 421 is constituted by a pair of core holding pieces that are extended as cantilevers from the two sides of the main body portion 420. In this case, the core holding pieces preferably are provided symmetrically, centered about the central portion in the width direction of the outer core portion 32.

The length of the core holding portion 421 along the height direction of the outer core portion 32 (length in the up-down direction in FIG. 5) is preferably 5% or more, more preferably 10% or more, and particularly preferably 25% or more, of the height of the outer core portion 32. By doing so, it is easier to suppress a case in which the outer core portion 32 comes off and position misalignment occurs due to the injection pressure of the resin in the process of forming the molded resin portion 6.

The length of the core holding portion 421 (length in the up-down direction in FIG. 3; hereinafter referred to as "thickness") in the direction orthogonal to both the extension direction and the height direction is preferably 0.5 mm or more, more preferably 1 mm or more, and particularly preferably 1.5 mm or more. By doing so, it is easier to suppress a case in which the outer core portion 32 comes off and is misaligned due to the injection pressure of the resin in the process of forming the molded resin portion 6. On the other hand, due to the thickness of the core holding portion 421 being 4 mm or less, furthermore 3 mm or less, or particularly 2 mm or less, the core holding portion 421 is not likely to protrude from the outer core portion 32 and it is possible to suppress an increase in the size of the core component 5. Note that if the later-described outer resin portion 62 includes a protruding portion 620 that covers the core holding portion 421 and protrudes from the outer core portion 32, the thickness of the core holding portion 421 can be selected as appropriate according to the protrusion length of the protruding portion 620.

The core holding portion 421 is provided at an intermediate position in the height direction of the outer core portion 32. The position at which the core holding portion 421 is provided can be selected as appropriate, and may be on the upper side or lower side in the height direction of the outer core portion 32. If the later-described outer resin portion 62 includes the protruding portion 620, the core holding portion 421 is provided at a position corresponding to the protruding portion 620.

In the present example, the core holding portion 421 is a band-shaped member that is provided continuously over the entire width from the one side surface 32*s* to the other side surface 32*s* of the outer core portion 32, at an intermediate position in the height direction of the outer core portion 32. Other than this, the core holding portion 421 may be a sheet-shaped member that is provided over the entire surface of the side surfaces 32*s* and the outer end surface 32*o* of the outer core portion 32. Also, if the core holding portion 421 is constituted by the above-described band-shaped member, multiple core holding portions 421 may be arranged in parallel at intervals in the height direction of the outer core portion 32.

Core Storage Portion

As shown in FIGS. 4 and 5, the core storage portion 422 is a recessed portion into which the end portion on the inner end surface 32*e* side of the outer core portion 32 is fit. The outer core portion 32 and the end surface interposed member 42A are integrally provided by fitting the end portion of the outer core portion 32 into the core storage portion 422, and thus it is easy to hold a state in which the outer core portion 32 is positioned with respect to the end surface interposed member 42A.

Turn Storage Portions

The turn storage portion 423 is a recessed portion that stores at least part of an axial direction end portion of the winding portion 2*c*. Two turn storage portions 423 are provided in correspondence with the two winding portions 2*c*. With the turn storage portions 423, the winding portions 2*c* can be positioned with respect to the end surface interposed member 42A, and thus it is easier to suppress a case in which the resin leaks from the contact portion between the end surface interposed member 42A and the winding portions 2*c* in the process of forming the molded resin portion 6.

Protruding Piece

The protruding pieces 424 are arranged along the corner portions of the inner core pieces 31*m* located on the end portions of the inner core portions 31, hold the corner portions of the inner core pieces 31*m*, and position the inner core pieces 31*m* (inner core portions 31) in the winding portions 2*c* by being interposed between the inner circumferential surfaces of the winding portions 2*c* and the inner core portions 31. The inner core portions 31 are positioned with respect to the end surface interposed member 42A by the protruding pieces 424, and as a result, it is possible to position the inner core portions 31 and the outer core portions 32 via the end surface interposed member 42A.

Resin Filling Hole

As shown in FIG. 5, resin filling holes 428 are formed on the upper side and lower side of the end surface interposed member 42A. In the present example, the resin filling holes 428 are slit-shaped. In the state of the combined body 10, the resin filling holes 428 communicate with the intervals formed between the inner circumferential surfaces of the winding portions 2*c* and the outer circumferential surfaces of the inner core portions 31.

Other End Surface Interposed Member

As shown in FIG. 4, the other end surface interposed member 42B provided separately from the outer core portion 32 is constituted by a frame-shaped member with a B shape having two through holes 427 that penetrate through the top and underside surfaces. The end surface interposed member 42B differs from the end surface interposed member 42A constituted by the core component 5 in that it includes through holes 427 and no interposed wall portion 425, and in that it does not include a core holding portion 421 that comes into close contact with the outer core portion 32, but they are the same in the other configurations. In other words, the end surface interposed member 42B includes: a core storage portion 422 on a side on which the outer core portion 32 is provided, relative to the through holes 427; and turn storage portions 423 and protruding portions 424 on a side on which the inner core portion 31 is arranged, relative to the through holes 427. The through holes 427 are formed such that when the combined body 10 is formed, an interval is formed between the end surface interposed member 42B and the outer core portion 32. The interval formed between the end surface interposed member 42B and the outer core portion 32 is a resin filling hole (not shown) that communicates with the interval formed between the inner circumferential surface of the winding portion 2*c* and the outer circumferential surface of the inner core portion 31.

Molded Resin Portion

As shown in FIGS. 2 and 3, the molded resin portion 6 integrally covers the magnetic core 3 (inner core portions 31 and outer core portions 32) and includes the inner resin portions 61 and the outer resin portions 62. The molded resin portion 6 is formed with a resin having an electrical insulation property, such as epoxy resin, unsaturated polyester resin, urethane resin, silicone resin, PPS resin, PTFE resin, LCP, PA resin, PI resin, PBT resin, and ABS resin. In the present example, the inner resin portions 61 and the outer resin portions 62 are formed with PPS resin. In the present example, the molded resin portion 6 does not cover the outer circumferential surfaces of the winding portions 2*c* and the winding portions 2*c* are exposed.

Inner Resin Portions

The inner resin portions 61 are formed by resin filling the intervals between the inner circumferential surfaces of the winding portions 2*c* and the outer circumferential surfaces of the inner core portions 31, and is in close contact with the inner circumferential surfaces of the winding portions 2*c* and the outer circumferential surfaces of the inner core portions 31. Also, in the present embodiment, as shown in FIG. 2, the resin that forms the inner resin portions 61 also fills the spaces between the inner core pieces 31*m* formed by the partitioning portions 410 of the inner interposed members 41.

Outer Resin Portions

The outer resin portions 62 are formed so as to cover at least part of the outer core portions 32. In the present example, the outer resin portions 62 are formed so as to cover the entireties of the outer core portions 32 exposed to the outside when the combined body 10 is combined, and in addition to the side surfaces 32*s* and the outer end surfaces 32*o*, the upper surfaces and lower surfaces of the outer core portions 32 are covered by the outer resin portions 62.

As shown in FIGS. 1 to 3, the outer resin portion 62 includes a protruding portion 620 that protrudes outward and is formed integrally. The protruding portion 620 includes fixing portions 621 for fixing the reactor 1 to the installation target (not shown). Also, the protruding portion 620 of the outer resin portion 62 (outer resin portion 62 shown on the left side in FIG. 1 and on the lower side in FIG. 3) that covers the outer core portion 32 constituted by the core component 5 includes a terminal platform 622 for fixing a terminal fitting (not shown) to be attached to the end portion of the coil 2 (winding wire 2*w*). The fixing portions 621 and the terminal platform 622 are formed integrally.

In the present example, the fixing portions 621 are provided on the outer resin portions 62 that cover both outer core portions 32, and two fixing portions 621 are provided on each outer resin portion 62. The fixing portions 621 are arranged on the left and right sides of the outer resin portions 62. A collar 621*c* (tube) made of metal is embedded in each fixing portion 621, and through holes into which bolts to be used as fixing implements are to be inserted are formed. The fixing of the reactor 1 to the installation target is performed by inserting bolts (not shown) into the collars 621*c* of the fixing portions 621 and fastening them in the bolt holes provided in the installation target. The number and positions of the fixing portions 621 can be changed as appropriate.

The terminal platform 622 is provided on the outer resin portion 62 that covers the outer core portion 32 constituted by the core component 5, and is not provided on the outer resin portion 62 that covers the other outer core portion 32. The terminal platform 622 includes fastening portions (nuts 622*n*) that fasten the terminal fittings connected to the end portions of the winding wires 2*w* and the terminal (not shown) of the external apparatus. In the present example, the terminal platform 622 is provided so as to span between the two fixing portions 621, and two nuts 622*n* are embedded in the terminal platform 622.

The fixing portions 621 and the terminal platform 622 protrude integrally outward from the side surfaces 32*s* and the outer end surface 32*o* of the outer core portion 32 to form one protruding portion 620, and the thickness of the terminal platform 622 is less than that of the fixing portions 621. In the present example, the protruding portion 620 is provided at an intermediate position in the height direction of the outer core portion 32. The position at which the protruding portion 620 is provided can be selected as appropriate, and may be on the upper side or lower side in the height direction of the outer core portion 32. As described above, the protruding portion 620 is provided covering the core holding portion 421 that is included on the end surface interposed member 42A constituted by the core component 5.

The molded resin portion 6 is formed through injection molding, for example. In the present embodiment, the outer resin portions 62 and the inner resin portions 61 are formed integrally through the resin filling holes 428 (FIG. 5) formed in the end surface interposed members 42A and 42B. The molded resin portions 6 integrate the inner core portions 31 and the outer core portions 32 and integrate the coil 2, the magnetic core 3, and the insulating interposed member 4 that constitute the combined body 10. Also, as shown in FIGS. 2 and 3, the resin also fills the through holes 427 of the end surface interposed member 42B.

Reactor Manufacturing Method

An example of a method for manufacturing the above-described reactor 1 will be described. The method for manufacturing the reactor representatively includes a core component production step, a combined body assembly step, and a resin molding step.

Core Component Production Step

In the core component production step, a core component 5 in which the outer core portion 32 and the end surface interposed member 42A are constituted integrally is produced (see FIG. 4). The outer core portion 32 is arranged in a mold, resin is injected into the mold, the resin is solidified, and thereby the end surface interposed member 42A is formed. When the resin is injected into the mold, the inner end surface 32*e* of the outer core portion 32 abuts against protrusions (pins) provided in the mold so as not to move in the mold. For this reason, the formed end surface interposed member 42A includes an interposed wall portion 425 so as to cover the inner end surfaces 32*e* of the outer core portions 32, but pin holes 426 (FIG. 5) corresponding to the pins in the mold are formed on the outer corner portions of the interposed wall portion 425. In the obtained core component 5, the end portion of the inner end surface 32*e* of the outer core portion 32 is fit into the core storage portion 422 of the end surface interposed member 42A and the core holding portion 421 of the end surface interposed member 42A is provided in close contact over the entire width from one side surface 32*s* of the outer core portion 32 to the other side surface 32*s*. Also, the turn storage portions 423 and protruding pieces 424 are formed on the end surface interposed member 42A on the side opposite to the outer core portion 32, and the resin filling holes 428 are formed above and outward in the width direction of the interposed wall portion 425.

Combined Body Assembly Step

In the combined body assembly step, the combined body 10 including the coil 2, the magnetic core 3, and the insulating interposed member 4 is assembled (see FIG. 4). The set of the coil 2, the inner core portions 31, and the inner interposed members 41 is produced by arranging the inner interposed members 41 between the inner core pieces 31*m* to produce the inner core portions 31 and inserting the inner core portions 31 into the two winding portions 2*c* of the coil 2. Thereafter, the core component 5 is arranged on one end portion of the winding portions 2*c* and the end surface interposed member 42B and the other outer core portion 32 are arranged on the other end portion of the winding portions 2*c*. Accordingly, a ring-shaped magnetic core 3 is constituted by the inner core portions 31 and the outer core portions 32. In the state of the combined body 10, the resin filling holes 428 formed in the end surface interposed member 42A constituted by the core component 5 communicate with the intervals formed between the inner circumferential surfaces of the winding portions 2*c* and the outer circumferential surfaces of the inner core portions 31 (see FIG. 5). Also, an interval is formed between the end surface interposed member 42B constituted separately from the outer core portion 32, and the outer core portion 32, and this interval communicates with the interval formed between the inner circumferential surface of the winding portion 2*c* and the outer circumferential surface of the inner core portion 31.

Resin Molding Step

In the resin molding step, the outer core portions 32 are covered by resin, resin fills the spaces between the inner circumferential surfaces of the winding portions 2*c* and the inner core portions 31, and thus the outer resin portions 62 and the inner resin portions 61 are formed integrally (see FIGS. 1 to 3). Resin molding is performed by arranging the combined body 10 in a mold and injecting resin into the mold from the outer core portion 32 sides of the combined body 10. At this time, the circumferential edge portions of the end surface interposed members 42A and 42B are fixed to the mold so that the combined body 10 does not move in the mold. Examples of injecting the resin into the mold include injecting the resin from the outer end surface 32*o* side of the outer core portion 32. In the present example, the resin is injected simultaneously from the outer end surface 32*o* sides of both outer core portions 32. The resin injected from the outer end surface 32*o* side of the outer core portion 32 constituted separately from the end surface interposed member 42B covers the outer core portion 32 and flows between the winding portion 2*c* and the inner core portion 31 through the interval formed between the end surface interposed member 42B and the outer core portion 32. On the other hand, the resin injected from the outer end surface 32*o* side of the outer core portion 32 constituted by the core component 5 covers the outer core portion 32, forms the fixing portions 621 and the terminal platform 622, and flows between the winding portions 2*c* and the inner core portions 31 via the resin filling holes 428 formed in the end surface interposed member 42A. At this time, the resin that flows between the winding portions 2*c* and the inner core portions 31 also fills the spaces between the inner core pieces 31*m* and the interval between the outer core portion 32 and the inner core portions 31 in which the interposed wall portion 425 is not included. Thereafter, by solidifying the introduced resin, the outer resin portion 62 and the inner resin portion 61 are formed integrally. Accordingly, the molded resin portion 6 is formed by the inner resin portions 61 and the outer resin portions 62, the inner core portions 31 and the outer core portions 32 are integrated, and the coils 2, the magnetic core 3, and the insulating interposed members 4 are integrated.

In the present example, the fixing portions 621 and the terminal platform 622 are formed only on the outer resin portion 62 that cover the one outer core portion 32 constituted by the core component 5, and therefore the filling state of the resin injected from the one outer core portion 32 side and the filling state of the resin injected from the other outer core portion 32 side are not uniform. Specifically, a case can occur in which, while the resin injected from the side of the one outer core portion 32 constituted by the core component 5 forms the fixing portions 621 and the terminal platform 622 and covers the outer core portion 32, the resin injected from the other outer core portion 32 side flows between the winding portions 2*c* and the inner core portions 31 and reaches the one outer core portion 32 side of the core component 5. In this case, the one outer core portion 32 constituted by the core component 5 receives the injection pressure of the resin that has flowed between the winding portions 2*c* and the inner core portion 31 from the other outer core portion 32 side. The core holding portion 421 formed on the end surface interposed member 42A constituted by the core component 5 covers the outer end surface 32*o* of the one outer core portion 32 and the outer core portion 32 is interposed between the core holding portion 421 and the main body portion 420, and therefore even if the one outer core portion 32 attempts to come off from the end surface interposed member 42A due to the injection pressure, the outer core portion 32 is supported on the end surface interposed member 42A side and a case is suppressed in which the outer core portion 32 comes off from the end surface interposed member 42A.

In the present example, a two-direction injection mode in which the resin is injected simultaneously from the outer end surface 32*o* sides of both outer core portions 32 is used as the mode of injecting the resin into the mold. Otherwise, a one-direction injection mode in which the resin is injected from only the outer end surface 32*o* side of the outer core portion 32 constituted separately from the end surface interposed member 42B may be used.

Effect

The above-described reactor 1 can suppress a case in which the outer core portion 32 is misaligned due to falling from the end surface interposed member 42A due to the injection pressure of the resin that flows between the winding portions 2*c* and the inner core portions 31 in the process of forming the inner resin portions 61 and the outer resin portions 62. This is because the outer core portion 32 that has a risk of receiving the injection pressure of the resin that flows between the winding portions 2*c* and the inner core portion 31 is constituted by the core component 5 provided integrally with the end surface interposed member 42A, and is held by being interposed between the main body portion 420 of the end surface interposed member 42A and the core holding portion 421. In particular, this is because the core holding portion 421 is provided continuously spanning from the one side surface 32*s* to the other side surface 32*s* of the outer core portion 32, whereby it is possible to effectively suppress a case in which the outer core portion 32 falls due to the above-described injection pressure.

Application

The reactor 1 of Embodiment 1 above can be suitably used in various converters, such as a vehicle-mounted converter (typically a DC-DC converter) mounted in a vehicle such as a hybrid automobile, a plug-in hybrid automobile, an electric automobile, or a fuel battery automobile, or a converter for an air conditioner, and in constituent components for electric power conversion apparatuses.

Modified Example 1

In Embodiment 1, a one-side core holding mode was described in which one of a pair of outer core portions 32 is constituted by a core component 5 provided integrally with an end surface interposed member 42A and the other of the pair of outer core portions 32 is constituted by another component provided separately from an end surface interposed member 42B. Other than this, it is also possible to use a two-side core holding mode in which both of the pair of core portions are constituted by core components provided integrally with the end surface interposed members and the outer core portions are held by being interposed between the main body portions and the core holding portions of the end surface interposed members.

Modified Example 2

In Embodiment 1, a mode was described in which the core holding portion 421 is provided continuously over the entire width from one side surface 32*s* to the other side surface 32*s* of the outer core portion 32, along the circumferential direction of the side surfaces 32*s* and the outer end surface 32*o* of the outer core portion 32. Other than this, the core holding portion may be provided continuously from the upper surface to the lower surface of the outer core portion, along the upper surface, the lower surface, and the outer end surface of the outer core portion.

LIST OF REFERENCE NUMERALS

1: Reactor
10: Combined body
2: Coil
2*w*: Winding wire
2*c*: Winding portion
2*j*: Bonding portion
3: Magnetic core
31: Inner core portion
31*m*: Inner core piece
32: Outer core portion
32*e*: Inner end surface
32*o*: Outer end surface
32*s*: Side surface
4: Insulating interposed member
41: Inner interposed member
410: Partitioning portion
411: Protrusion piece
42A, 42B: End surface interposed member
420: Main body portion
421: Core holding portion
422: Core storage portion
423: Turn storage portion
424: Protrusion piece
425: Interposed wall portion
426: Pin hole
427: Through hole
428: Resin filling hole
5: Core component
6: Molded resin portion
61: Inner resin portion
62: Outer resin portion
620: Protrusion portion
621: Fixing portion
621*c*: Collar
622: Terminal platform
622*n*: Nut

What is claimed is:

1. A reactor comprising:

a coil having winding portions;

a magnetic core including inner core portions arranged inside of the winding portions and a pair of outer core portions arranged outside of the winding portion so as to sandwich the inner core portions;

end surface interposed members including main body portions that are interposed between end surfaces of the winding portions and the outer core portions, and resin filling holes that communicate with the interiors of the winding portions;

inner resin portions that fill spaces between inner circumferential surfaces of the winding portions and the inner core portions; and outer resin portions that cover at least part of the outer core portions and are connected to the inner resin portions through the resin filling holes, wherein at least one of a pair of the outer core portions and an end surface interposed member are constituted by a core component that is formed integrally, and the end surface interposed member of the core component includes a core holding portion that is extended from the main body portion to the outer core portion side, the outer core portion being interposed between the core holding portion and the main body portion.

2. The reactor according to claim 1, wherein the core holding portion is provided continuously spanning from one side surface to another side surface of the outer core portion.

3. The reactor according to claim 1, wherein the outer resin portion includes a protruding portion that covers the core holding portion and protrudes from the outer core portion.

4. The reactor according to claim 1, wherein the end surface interposed member in the core component includes an interposed wall portion that is interposed between the inner core portions and the outer core portion.

5. The reactor according to claim 1, wherein the end surface interposed members include turn storage portions that store at least a portion of turns on axial direction end portions of the winding portions.

* * * * *